United States Patent [19]

Geisler

[11] Patent Number: 4,608,329

[45] Date of Patent: Aug. 26, 1986

[54] IMAGEABLE TONER POWDER

[75] Inventor: Thomas C. Geisler, Cottage Grove, Minn.

[73] Assignee: Minnesota Mining and Manufacturing Company, St. Paul, Minn.

[21] Appl. No.: 689,706

[22] Filed: Jan. 8, 1985

[51] Int. Cl.[4] ..... G03G 9/08; G03G 9/16

[52] U.S. Cl. ..... 430/110; 430/109; 430/291; 430/903; 430/964; 430/965

[58] Field of Search ..... 430/109, 291, 903, 964, 430/965, 110

[56] References Cited

U.S. PATENT DOCUMENTS

| | | | |
|---|---|---|---|
| 3,473,923 | 10/1969 | Ohkubo et al. | 430/291 X |
| 3,609,082 | 9/1971 | Moriconi et al. | 430/109 |
| 4,162,226 | 7/1979 | Chatterji | 430/109 |
| 4,461,822 | 7/1984 | Abele | 430/291 X |
| 4,461,823 | 7/1984 | Held | 430/109 X |

*Primary Examiner*—Roland E. Martin

*Attorney, Agent, or Firm*—Donald M. Sell; James A. Smith; James V. Lilly

[57] ABSTRACT

An imageable toner powder comprising a solid material capable of existing as a supercooled liquid after being heated above its melting temperature and subsequently cooled and a colorant.

16 Claims, No Drawings

IMAGEABLE TONER POWDER

This invention relates to toner powders and to thermal imaging techniques. More particularly it relates to imageable toners and to thermal imaging techniques wherein heat is used to form a latent liquid image which is subsequently developed.

Heat-initiated image generation processes (i.e., thermographic processes) are known. In one aspect they cause a heat-sensitive material to become either tacky or fluid in exposed areas to form latent images which may then be developed with a toner powder. Examples of such processes are disclosed in U.S. Pat. Nos. 3,196,029; 3,260,612; 3,515,570; and 3,941,596.

These processes have employed conventional heat and/or pressure fixable toner powders to develop the latent image areas. However, such toners are not themselves imageable and, as a result, it is not possible to readily superimpose a second layer of toner over the developed image. Consequently, such toners cannot be easily used to provide multicolor copies. Furthermore, once such heat and/or pressure fixable toners have been applied to an image area, the heat and pressure applied in subsequent imaging steps by imaging means such as thermal print heads cause their removal from the substrate.

SUMMARY OF THE INVENTION

The toner powder of the present invention overcomes the disadvantages of heat and/or pressure fixable toners. The toners of the invention comprise at least 50 weight percent of a supercoolable material and at least 0.01 weight percent of a colorant. Preferably the toners comprise from 75 to 99.5 weight percent of the supercoolable material and, correspondingly from about 25 to 0.5 weight percent of the colorant.

Subsequent to being used to develop an image on a substrate, the images toned by the toners of the invention may be reimaged so that a second layer of the same or a differently colored toner may be applied over at least a portion of the previously toned image. This is accomplished without removing the previously developed image and enables one to readily form multi-color images.

Typically the toner powders of the invention soften at a temperature in the range of 40° to 140° C., and have a particle size in the range of 0.5 to 50 micrometers (μm). They may be of any shape desired. Thus, they may be spherical, cubical, etc., or they may be irregular and have rough edges.

DETAILED DESCRIPTION

The supercoolable material used in the invention is one which is capable of existing in a supercooled state after it has been melted and subsequently cooled below its melting temperature. In the supercooled state, this material exists, at least temporarily, in a metastable liquid state. Preferably the supercoolable material is normally solid and non-tacky. It typically has a melting temperature at least 10° C. above ambient. Ambient temperature, in this sense, means the temperature of the environment in which the toner is used, for example 10° C. to 40° C.

After the toner of the invention has been used to develop a latent image, the toned image may itself be thermally imaged. The toned areas which have been imaged will remain fluid (even after being cooled below their melting temperature) and in place until they are subsequently developed or toned. However, once the supercoolable material of the toner regains its normal solid state, it must be reimaged before it can be developed.

Suitable supercoolable materials may be readily identified by means of their melting temperature and supercooling characteristic. A Leitz hot stage microscope having an electrically heated stage and temperature measuring means and which may be cooled by circulation of cold water is used for both determinations. The melting temperature (or melting range if no single melting temperature exists) may be determined by placing a small amount of the supercoolable material in powder form on a glass microscope slide, covering the sample with a cover glass, heating on the microscope and observing the temperature at which the particles melt. For the sake of uniformity, it is preferred that heating take place at a rate of from 2° C. to 5° C. per minute.

The supercooling characteristic is determined using the same sample used to measure the melting point. After the stage has been heated above the melting point of the sample, it is cooled and the temperature noted at which solidification occurs. Again, for the sake of uniformity, it is preferred that cooling take place at a rate of from 2° C. to 5° C. per minute. Materials which when thus treated remain liquid to a temperature well below their melting points are effective. Materials which solidify at their melting points are not useful in the invention. Preferably, materials useful in the invention have melting points in the range of 40° C. to 140° C. and remain liquid after they have been heated above their melting temperature and subsequently cooled to at least 20° C. below their melting temperature.

A number of supercoolable materials are useful in the coatings of the invention. Representative examples of these materials include dicyclohexyl phthalate, diphenyl phthalate, triphenyl phosphate, dimethyl fumarate, benzotriazole, 2,4-dihydroxy benzophenone, tribenzylamine, benzil, vanillin, and phthalophenone. Another useful material of this type is "Santicizer 9", a mixture of ortho- and para-toluene sulfonamides commercially available from the Monsanto Chemical Company. Mixtures of these materials are also useful. The supercoolable material can also consist of two or more materials that are not supercoolable by themselves, but are combinable to form a supercoolable material.

The colorant employed in the invention renders the toner visible. It may be selected from pigments or dyes and should not interfere with the ability of the supercoolable material to form the metastable liquid.

A wide variety of pigments may be employed in the invention. For example, useful pigments include carbon black, acetylene black, lamp soot, aniline black, chromium yellow, zinc yellow, cadmium yellow, yellow iron oxide, mineral fast yellow, nickel-titanium yellow, naples yellow, naphthol yellow 5, hansa-yellow G, hansa-yellow 10G, benzidine yellow G, benzidine yellow GR, quinoline yellow mordant, permanent yellow NCG, tartrazin mordant, pigment yellow 17, chromium orange, molybdenium orange, permanent orange GTR, pyrazolone orange, vulcano orange, indanthrene brilliant orange RK, benzidine orange G, indanthrene brilliant orange GK, red iron oxide, du Pont oil red, cadmium red, red lead, mercury sulfide, cadmium permanent red 4R, lithol-red, pyrazolone red, watchung-red Ca-salt, mordant red D, brilliant carmine 6B, eosin mordant, rhodamine mordant B, alizarine mordant, brilliant carmine 3B, pigment red 48:2, rose bengal, manganese violet, fast violet B, methylviolet mordant, prussian blue, cobalt blue, alkali blue mordant, victoria blue mordant, phthalocyanine blue, metal-free phthalocyanine blue, fast light blue, indanthrene blue BC, chromium green, chromium oxide, pigment green B, malachite green mordant, malachite green oxolate, fanal yellow-green G, zinc white titanium oxide, antimony white, zinc sulfide, barite powder, barium carbonate, clay, silica, white carbon, talc, alumina white, iron oxide ($Fe_3O_4$), ferric oxide ($\gamma$-$Fe_2O_3$), zinc-iron oxide ($ZnFe_2O_4$), yttrium-iron oxide ($Y_3Fe_5O_{12}$), cadmium-iron oxide ($CdFe_2O_4$), gadolinium-iron oxide ($Gd_3Fe_5O_{12}$), copper-iron oxide ($CuFe_2O_4$), lead-iron oxide ($PbFe_{12}O_{19}$), nickel-iron oxide ($NiFe_2O$), neodym-iron oxide ($NdFeO_3$), barium-iron oxide ($BaFe_{12}O_{19}$), magnesium-iron oxide ($MgFe_2O_4$), manganese-iron oxide ($MnFe_2O_4$), lanthanum-iron oxide ($LaFeO_3$), iron powder (Fe), cobalt powder (Co), and nickel powder (Ni).

Useful dyes are also well known and include, for example, Savinyl blue dye, oil blue A dye, Neozapon red 395 dye, nigrosine dye, aniline blue dye, ultramarine blue dye, methylene blue chloride, phthalocyanine blue dye, Amoplast yellow GHS, etc..

Various other ingredients may be included in the toner powders of the invention. For example, up to 20 weight percent of a binder may be included. The binders are organic thermoplastic resins which are compatible with the supercoolable material and which at least soften when heated by an imaging device such as a thermal print head. Representative examples of suitable binders include organic solvent soluble materials such as cellulose acetate, cellulose acetate butyrate, ethyl cellulose and polyvinyl chloride.

Yet another ingredient which may be utilized in the toners of the invention are antifouling materials. These materials are employed at levels up to 40 weight percent of the toner and are particularly useful when the toner is to be imaged by a device which directly contacts the toner such as a thermal print head. They serve to minimize the build-up of the toner material upon the device due to contact with the toner.

A variety of materials are useful as the antifouling agent. Such materials include waxes, silicas, metal silicates, and mixtures thereof. Representative examples of useful waxes include aliphatic alcohols such as cetyl, stearyl, lauryl, and myristyl alcohols and mixtures thereof, fatty acids such as palmitic, stearic, lauric and myristic acids and mixtures thereof, fatty amides such as stearamide, lauramide, oleamide, ethylene-bis-stearamide and mixtures thereof, fatty acid esters such as glyceryl monostearate and diethylene glycol monostearate, glycol stearates, cetyl palmitate, stearyl stearate, n-butyl stearate, n-octyl stearate, and ketones derived from fatty acids such as stearone and laurone.

Other useful waxes include metal salts of fatty acids such as octoates, laurates, palmitates, and stearates of aluminum, lead, cadmium, barium, calcium, lithium, magnesium, and zinc. The metal stearates are most preferred. Blends of metal salts of fatty acids, e.g. zinc stearate, and fatty acids, e.g. stearic acid, are also useful.

Silicas and metal silicates useful in the invention include silica gel, fumed silica, precipitated silica, clay, kaolin, and talc.

The toners of the present invention may be readily used in thermal imaging systems. For example, a substrate bearing a material capable of forming or receiving a latent liquid image is provided and imaged. The latent image, which is essentially invisible to the naked eye, is developed by contacting it with the toner of the invention. The developed image may optionally be subjected to a heat and/or pressure fixing step. However, a fixing step is generally not necessary to achieve adequate fixing in the present invention. Merely allowing the latent image to resolidify is sufficient.

The mechanism for forming the latent image may vary. For example, it may be stamped onto the substrate, applied by ink jet techniques, or, alternatively, be formed by image-wise heating a heat-sensitive material to cause it to become tacky or fluid using, for example, a thermal print head.

The toner powder may be applied to the latent image in a variety of ways. For example, if magnetically responsive materials (such as magnetically responsive pigments) are utilized in the toner, magnetic development techniques may be utilized. Alternatively, the toner may be applied by merely brushing or pouring it over the substrate. In any event, the toner exhibits differential adhesion to the image and non-image areas so that it does not attach to the non-image areas. As a result, the toner may be removed from non-image areas by either brushing or vibrating the substrate. Alternatively it may be blown off by means of a stream of air. Other removal techniques are also possible.

At least a portion of the toned images may themselves be imaged by heating the desired portions thereof for a time and to a temperature sufficient to cause the toner to form a second latent image. This second latent image may then be developed by contacting it, as described above with respect to the first latent image, with a second toner powder. This process of reimaging and retoning may be repeated for as many times as desired. However, non-imageable toners (e.g., conventional heat and/or pressure-fixing toners) may be used in subsequent imaging steps if further reimaging is not desired.

The substrate employed in the process of the invention may be chosen from a variety of materials. It may be transparent or opaque and is preferably thin and flexible. Thus, the substrate may be selected from, for example, paper, polymeric films such as polyesters, cellulose triacetate, polypropylene, etc., anodically oxidized aluminum and foils of metals such as aluminum, copper, zinc, etc.

The present invention is illustrated by the following representative examples.

EXAMPLE 1

An imageable toner powder according to the invention was prepared by dissolving 0.25 g oil blue A dye in 50 g liquid dicyclohexylphthalate (DCHP) at 95° C. This solution was allowed to cool and solidify. The mixture was crushed, ground in a mortar and pestle and sieved through a #325 screen, producing a blue toner powder with particle size less than 45 $\mu$m. A 5 centimeter (cm) diameter circular tacky latent image was produced on a sheet coated with a 4.8 to 1 mixture of DCHP and N200 ethyl cellulose (coat weight=0.13 kg/m$^2$) using an EMT 9140 thermal facsimile. The latent image was developed with the blue toner powder (magnetic brush) yielding a solid blue circle. This sheet was then reimaged on the EMT 9140 producing a second circular, tacky latent image partially overlapping the first circle. Development with Xerox 6500 magenta toner (magnetic brush) resulted in a magenta image in the non-overlapping area and a purple image in the overlapping area.

EXAMPLE 2

A series of imageable toner powders according to the invention were prepared by heating the colorant and the supercoolable material at a temperature above the melting temperature of the latter until a uniform product was obtained. This product was cooled until solid, broken into chunks and then ball milled until the particle size of the toner was less than 30 μm.

Five cm diameter circular tacky latent images were produced using the same type of sheet and the same procedures used in Example 1. The separate latent images were developed with the toners using various techniques. A solid circle having the color of the toner resulted on each sheet. These sheets could be reimaged and redeveloped to produce multicolor images.

The formulations used in this example are set forth in Table 1 wherein all percents are weight percents. Examples 2A–2E were developed by brushing a camel hair brush loaded with the toner across the latent image and then cleaning the background with a dry cotton pad. Examples 2F–2H were developed by the magnetic brush technique.

TABLE 1

| | A | B | C | D | E | F | G |
|---|---|---|---|---|---|---|---|
| Supercoolable Material (%) | | | | | | | |
| DCHP | 92.9 | 91.9 | | | 93.1 | 98 | 89.1 |
| Diphenyl Phthalate (DPP) | | | 92.8 | 92.8 | | | |
| Colorant (%) | | | | | | | |
| Pigment Yellow 17 | 2.0 | | | | | | |
| Pigment Red 48:2 | | 3.1 | | | | | |
| Savinyl Blue Dye | | | 2.1 | 2.1 | | | |
| Oil Blue A Dye | | | | | 1 | | |
| Neozapon Red 395 Dye | | | | | | 2 | |
| Amoplast Yellow GHS | | | | | | | 1 |
| Binder (%) | | | | | | | |
| Ethyl Cellulose N-200 (From Hercules, Inc.) | 5.1 | 4 | | | 6 | | 9.9 |
| Ethyl Cellulose N-22 (From Hercules, Inc.) | | | 5.1 | | | | |
| Gelva V-800 (Polyvinyl Chloride Resin from Hercules, Inc.) | | | | 5.1 | | | |
| Particle Size (μm) | 1–20 | 1–15 | 1–30 | 2–20 | <5 | <5 | <10 |

EXAMPLE 3

Toner powders were prepared using the procedures described in Example 2 from the following formulations:

TABLE 2

| | A | B | C | D |
|---|---|---|---|---|
| DCHP (Wgt. %) | 99 | 93.1 | 82.2 | 69.3 |
| Oil Blue A Dye (Wgt. %) | 1 | 1 | 1 | 1 |
| Ethyl Cellulose N-200 | — | 5.9 | 16.8 | 29.7 |

The product of Examples 3A, 3B, and 3C were ground to a toner powder whose particles ranged in sizes from 1 to 40 μm. They were used according to the techniques of Example 1 to develop latent images. The developed images were solid blue in color.

The product of Example 3D was too rubbery to grind and could not be used as a toner powder.

I claim:

1. A thermally imageable toner powder of particles comprising at least 50 weight percent of a supercoolable material, at least 0.01 weight percent of a colorant, up to 20 weight percent of a binder and up to 40 weight percent of an antifouling agent.

2. A toner according to claim 1 comprising from 75 to 99.5 weight percent of said supercoolable material and correspondingly from 25 to 0.5 weight percent of said colorant.

3. A toner according to claim 1 wherein said supercoolable material comprises a normally solid, non-tacky material.

4. A toner according to claim 3 wherein said normally solid, non-tacky material has a melting temperature at least 10° C. above ambient and which forms a supercooled melt when cooled to a temperature below its melting temperature.

5. A toner according to claim 4 wherein said ambient temperature is in the range of 10° to 40° C.

6. A toner according to claim 3 wherein said supercoolable material is selected from the group consisting of dicyclohexyl phthalate, diphenyl phthalate, triphenyl phosphate, dimethyl fumurate, benzotriazole, 2,4-dihydroxy benzophenone tribenzylamine, benzil, vanillin, phthalophenone, and mixtures of ortho- and para-toluene sulfonamides.

7. A toner according to claim 6 wherein said supercoolable material is selected from the consisting of diphenyl phthalate, triphenyl phosphate and dicyclohexyl phthalate.

8. A toner according to claim 1 wherein said colorant comprises a pigment.

9. A toner according to claim 1 wherein said colorant comprises a dye.

10. A toner according to claim 1 comprising from 1 to 20 weight percent of said binder.

11. A toner according to claim 1 wherein said binder solvent is soluble in an organic solvent.

12. A toner according to claim 11 wherein said binder is selected from the group consisting of cellulose acetate, cellulose acetate butyrate, ethyl cellulose, and poly(vinyl chloride).

13. A toner according to claim 12 wherein said binder is selected from the group consisting of ethyl cellulose and poly(vinyl chloride).

14. A toner powder for developing images which is capable of being subsequently thermally imaged and developed by application of a second toner powder, said toner powder comprising (a) from 50 to 99.99 weight percent of a supercoolable material, (b) from 25 to 0.01 weight percent of a colorant, (c) up to 20 weight percent of a binder, and (d) up to 40 weight percent of an antifouling material.

15. A toner powder consisting essentially of at least 50 weight percent of a supercoolable material, at least 0.01 weight percent of a colorant, up to 20 weight percent of a binder and up to 40 weight percent of an antifouling agent, wherein said toner, after use to develop an image on a substrate, may be thermally imaged and developed by application of a second toner powder.

16. A toner powder according to claims 14 or 15 consisting of said supercoolable material and said colorant.

* * * * *